US007418956B2

(12) United States Patent
Aida et al.

(10) Patent No.: US 7,418,956 B2
(45) Date of Patent: Sep. 2, 2008

(54) IGNITION APPARATUS FOR AN INTERNET COMBUSTION ENGINE

(75) Inventors: Futoshi Aida, Tokyo (JP); Yusuke Naruse, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/715,453

(22) Filed: Mar. 8, 2007

(65) Prior Publication Data

US 2008/0092865 A1 Apr. 24, 2008

(30) Foreign Application Priority Data

Oct. 20, 2006 (JP) ..... 2006-285990

(51) Int. Cl.
*F02P 3/06* (2006.01)
*F02P 17/00* (2006.01)

(52) U.S. Cl. ..... 123/605; 123/594; 123/650; 324/380

(58) Field of Classification Search ..... 123/594, 123/596, 605, 609, 650, 644; 324/382, 380, 324/388, 391; 73/35.08
See application file for complete search history.

(56) References Cited

U.S. PATENT DOCUMENTS 7,063,079 B2 * 6/2006 Huberts et al. ..... 123/630
7,178,513 B2 * 2/2007 Ward ..... 123/634
2004/0007222 A1 * 1/2004 Skinner et al. ..... 123/609
2004/0084034 A1 * 5/2004 Huberts et al. ..... 123/630
2004/0084035 A1 * 5/2004 Newton ..... 123/630
2004/0085068 A1 * 5/2004 Zhu et al. ..... 324/382
2006/0009886 A1 * 1/2006 Sakurai et al. ..... 701/1

FOREIGN PATENT DOCUMENTS

JP 10-176647 A 6/1998

* cited by examiner

*Primary Examiner*—John T Kwon
(74) *Attorney, Agent, or Firm*—Sughrue Mion, PLLC

(57) ABSTRACT

An ignition apparatus for an internal combustion engine can be produced at low cost and small size by preventing the generation of a spark at a spark plug due to a turn-on voltage with a simple ignition coil construction having no energy loss. The apparatus include an ignition coil having a primary coil and a secondary coil, a spark plug to which a high voltage from the secondary coil is impressed, and a coil driver for driving the ignition coil. The coil driver has a switching element for controlling the primary current, an IC for driving the switching element, and a turn-on voltage prevention circuit inserted between a secondary coil low-voltage side terminal and ground. The turn-on voltage prevention circuit is composed of a parallel circuit comprising a diode in the form of a bare chip and a thick film resistor, and is mounted on the same substrate together with the IC.

5 Claims, 4 Drawing Sheets

IGNITION APPARATUS FOR AN INTERNET COMBUSTION ENGINE

BACKGROUND OF THE INVENTION

1. Field of the Invention

The present invention relates to an ignition apparatus including a spark plug, an ignition coil and a coil driver of an internal combustion engine (hereinafter also referred to as an "engine"), and more particularly, it relates to a new advanced technology for a coil driver for driving the ignition coil.

2. Description of the Related Art

In general, in an ignition apparatus for an internal combustion engine that is provided with an ignition coil having a primary coil and a secondary coil and a switching element (e.g., IGBT) for turning on and off (energize and deenergize) a primary current of the ignition coil, a predetermined high voltage (ignition voltage) generated at the secondary coil side when the primary current to the primary coil is switched from an energized state (on) into an interrupted state (off) is impressed to a spark plug, whereby a spark occurs at the spark plug, thereby driving the engine.

However, on the contrary, when the primary current is switched from the interrupted state (off) into the energized state (on), a turn-on voltage (opposite in polarity to the ignition voltage) generated at the secondary coil side is impressed to the spark plug to generate a spark therefrom at a timing other than the predetermined timing, whereby abnormality vibration or the like is caused to the engine. Accordingly, there is a possibility that normal operation of the engine is disturbed or inhibited.

Accordingly, there has also been proposed an ignition apparatus for an internal combustion engine in which the value of the turn-on voltage generated upon energization of the primary current is made lower than the voltage value of a normal ignition voltage that causes a spark plug to generate a spark upon interruption of the primary current (see, for example, a first patent document: Japanese patent application laid-open No. H10-176647).

In the conventional motor control apparatus described in the above-mentioned first patent document, it is constructed such that the turn-on voltage generated when the energization of the primary coil is switched from the off state to the on state is not impressed to the spark plug by inserting a high voltage diode having a withstand voltage (e.g., about 5 [kV]) higher than the turn-on voltage in a low-voltage side terminal (or a high-voltage side terminal) of the secondary coil with the turn-on voltage acting as a reverse voltage.

In this case, the high voltage diode is in general an expensive and large-sized discrete part, and is constructed as a circuit separated from the coil driver having the switching element. A high voltage generated upon interruption of the primary current is in a forward direction with respect to the high voltage diode, so a voltage impressed to the spark plug is not made lower and an energy loss never occurs.

In the conventional ignition apparatus for an internal combustion engine, the high voltage diode in the form of the expensive and large-sized discrete part is used so as to prevent the turn-on voltage from being impressed to the spark plug. As a result, there is a problem that an increase in the number of man-hours and an increase in cost are invited when the high voltage diode is built into the ignition coil.

In addition, there is also a problem that the degree of freedom in mounting the high voltage diode is limited because of the high voltage diode being in the form of the discrete part.

Further, when the high voltage diode for prevention of the turn-on voltage is to be mounted on a substrate of the coil driver, there will exist a low voltage system (e.g., an IC including a current limiting circuit and a waveform shaping circuit) having a low withstand voltage against a high voltage on the substrate of the coil driver in a mixed relation with the high voltage diode, so in order to separate the high voltage diode and the low voltage system in the coil driver from each other, it is necessary to arrange these parts in a divided manner by the use of a plurality of substrates or to form a guard or the like for protection of the low voltage system. Accordingly, there is a further problem that the number of production steps or processes and the number of component parts increase, thus inviting an increase in cost.

SUMMARY OF THE INVENTION

Accordingly, the present invention is intended to solve the problems as referred to above, and has for its object to obtain an ignition apparatus for an internal combustion engine which can be produced at low cost and small size by achieving a turn-on voltage prevention circuit, which serves to prevent the generation of a spark at a spark plug due to a turn-on voltage, with a simple construction having no energy loss.

Bearing the above object in mind, according to the present invention, there is provided an ignition apparatus for an internal combustion engine which includes: an ignition coil having a primary coil and a secondary coil; a spark plug that is arranged in a combustion chamber of the internal combustion engine and is connected to a high voltage side terminal of the secondary coil; and a coil driver that drives the ignition coil. The coil driver includes: a switching element that controls a primary current flowing through the primary coil based on an ignition signal; an IC that shapes the waveform of the ignition signal supplied to the switching element; and a turn-on voltage prevention circuit that is inserted between a low-voltage side terminal of the secondary coil and a ground. The turn-on voltage prevention circuit is composed of a parallel circuit comprising a diode in the form of a bare chip and a thick film resistor, and is mounted on the same substrate together with the IC.

According to the present invention, it is not necessary to use a plurality of substrates (or to form a protective guard or the like) for divided arrangement of a high voltage system in the coil driver and the IC (low voltage system) so as to arrange them separately from each other, thereby making it possible to reduce the number of production steps or processes as well as the number of component parts required.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described below in detail while referring to the accompanying drawings.

Embodiment 1

Figure 1:
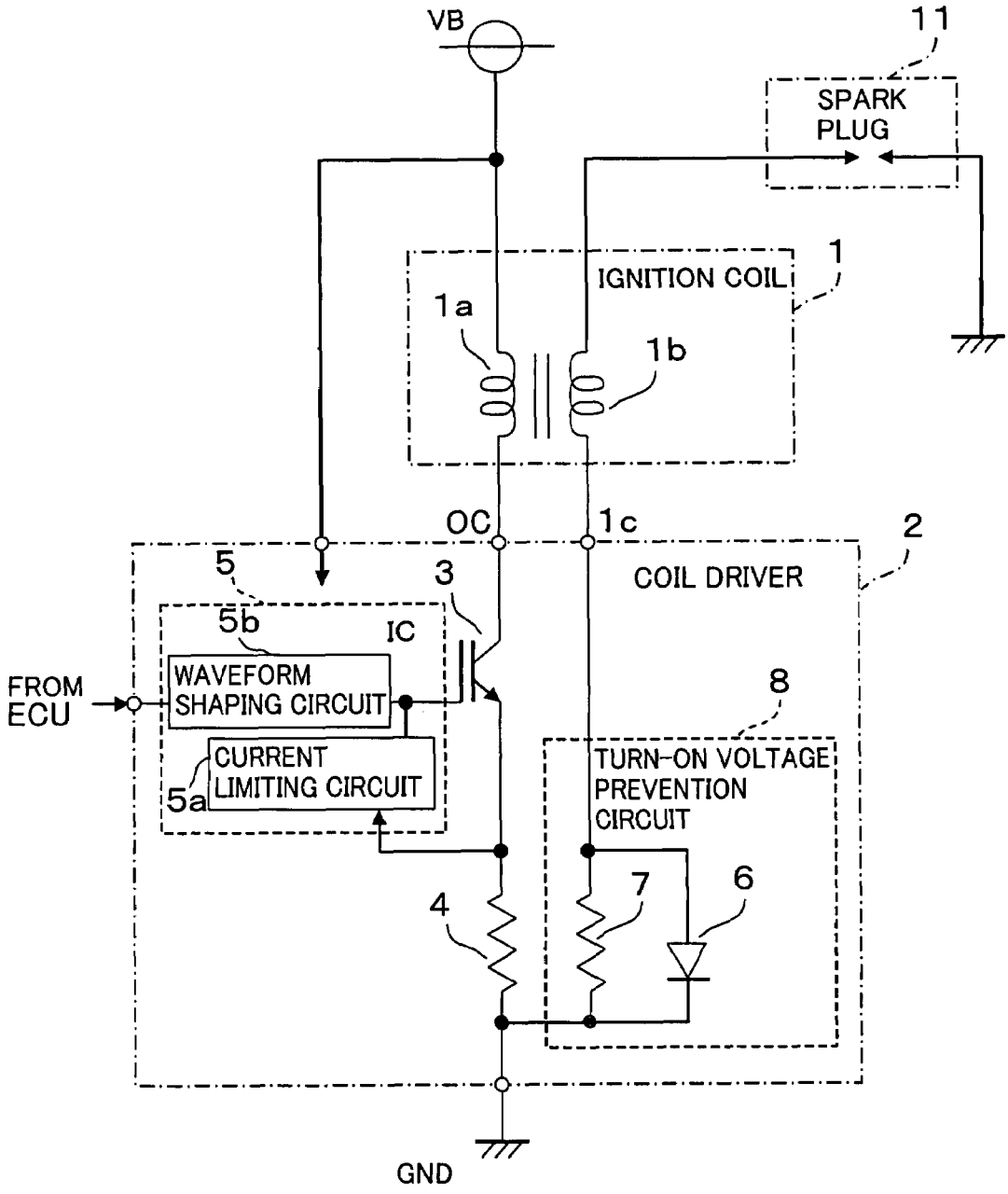
FIG. 1 is a circuit block diagram showing the configuration of an ignition coil and its peripherals in an ignition apparatus for an internal combustion engine according to a first embodiment of the present invention.
Figure 2:
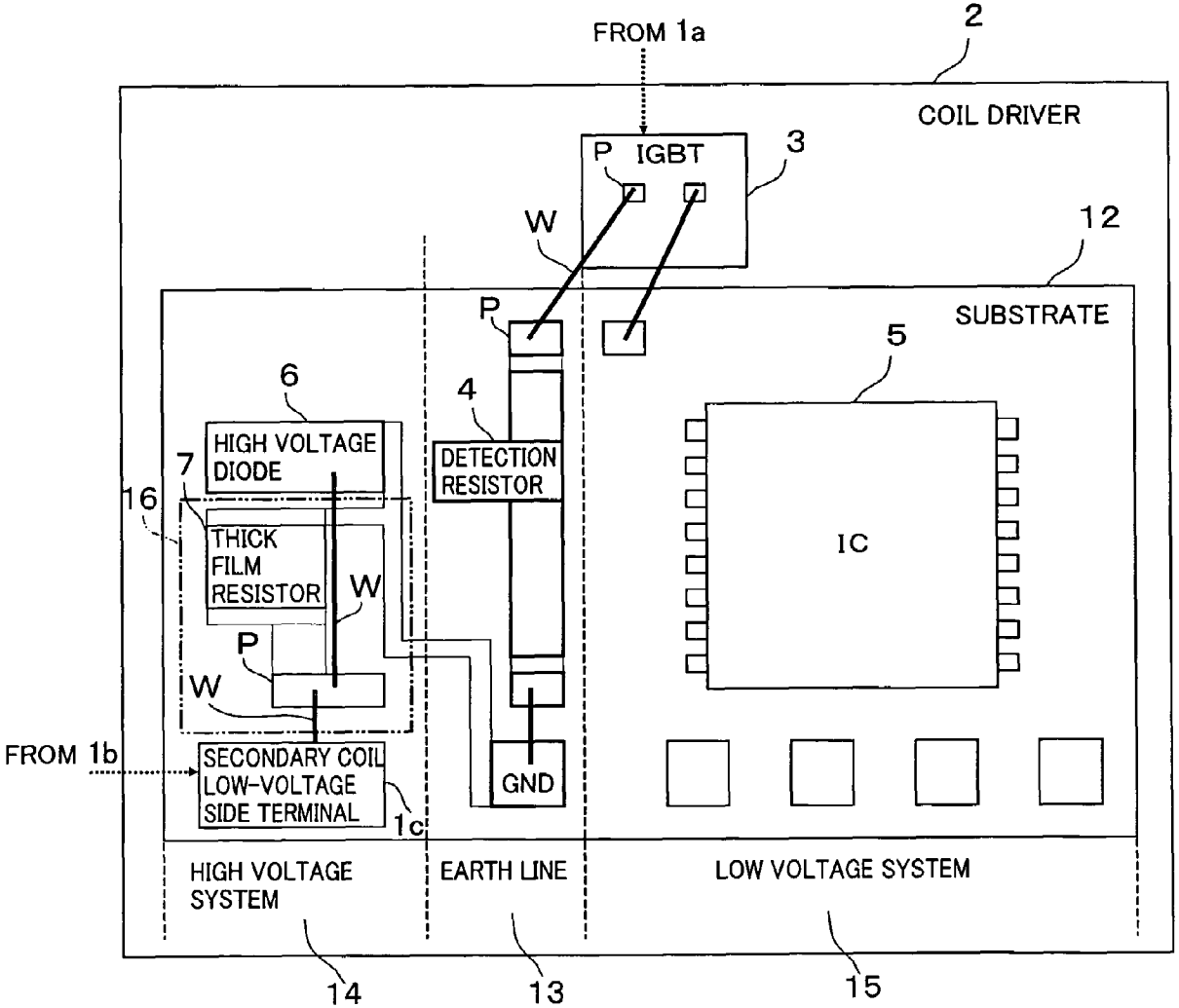
FIG. 2 is an explanatory view showing a planar construction of a mounting pattern on a coil driver according to the first embodiment of the present invention.

Referring to the drawings and first to FIG. 1, there is shown, in a circuit block diagram, the configuration of an ignition coil and its peripherals in an ignition apparatus for an internal combustion engine according to a first embodiment of the present invention, and FIG. 2 is an explanatory view that shows a planar construction of a mounting pattern on a coil driver according to the first embodiment of the present invention.

In FIG. 1, an ignition coil 1 is composed of a primary coil 1*a* having one end thereof connected to a power supply VB (e.g., a voltage value of 14 V) and a secondary coil 1*b* arranged in opposition to the primary coil 1*a*. The primary coil 1*a* has the other end thereof connected to a coil driver 2 through a collector terminal OC (Open Collector), and further to a ground GND through the coil driver 2.

The secondary coil 1*b* has one end thereof or a high-voltage side terminal grounded to the ground GND through a spark plug 11, and the other end thereof connected to the coil driver 2 through a secondary coil low-voltage side terminal 1*c* and further to the ground GND through the coil driver 2. The spark plug 11 is arranged in a combustion chamber of an internal combustion engine (not shown), so that when a high voltage (ignition voltage) generated from the secondary coil 1*b* upon interruption of the energization of the primary coil 1*a* is impressed to the spark plug 11, a spark is caused to generate in a gap between opposed electrodes of the spark plug 11 to explode and burn an air fuel mixture in the combustion chamber.

The coil driver 2 for driving the ignition coil 1 is provided with a switching element (e.g., IGBT) 3 for interrupting the energization of a primary current flowing through the primary coil 1*a*, a detection resistor 4 inserted between an emitter terminal of the switching element 3 and the ground GND for detecting the primary current, a low-voltage side IC (hereinafter simply referred to as an "IC") 5 for driving on and off the switching element 3, and a turn-on voltage prevention circuit 8 inserted between the secondary coil low-voltage side terminal 1*c* and the ground GND.

The IC 5 is powered by the power supply VB, so that it takes in a primary current detected value from the detection resistance 4, and at the same time operates in response to a control signal from an unillustrated engine control unit (ECU). The ECU generates the control signal for the coil driver 2 on the basis of calculation processing in accordance with the operating state of the internal combustion engine.

The IC 5 impresses an ignition signal to a gate terminal of the switching element 3 in response to the control signal from the ECU thereby to drive the switching element 3 on and off. Also, the IC 5 includes a current limiting circuit 5*a* that limits the primary current based on the primary current detected value and a waveform shaping circuit 5*b* for shaping the waveform of the ignition signal supplied to the switching element 3.

The turn-on voltage prevention circuit 8 in the coil driver 2 is in the form of a parallel circuit comprising a high voltage diode 6 formed of a bare chip (hereinafter simply referred to as a "diode") and a thick film resistor 7. The turn-on voltage prevention circuit 8 is inserted between the secondary coil low-voltage side terminal 1*c* and the ground GND.

In FIG. 2, the coil driver 2 is provided with a substrate (e.g., ceramic substrate) 12 having a plurality of pad electrodes P, and the substrate 12 is connected to other circuit elements and an external circuit (not shown) through wire bonding of a plurality of pad electrodes P and wires W. Mounted on the substrate 12 there are the secondary coil low-voltage side terminal 1*c*, the detection resistor 4, the IC 5, the diode 6 in the turn-on voltage prevention circuit 8 (see FIG. 1), the thick film resistor 7 in the turn-on voltage prevention circuit 8, and a terminal for the ground GND.

As divided by broken lines in FIG. 2, the detection resistor 4 in the coil driver 2 and the ground GND together constitute an earth line 13; the secondary coil low-voltage side terminal 1*c*, the diode 6 and the thick film resistor 7 together constitute a high voltage system 14; and the switching element (IGBT) 3 and the IC 5 (including the current limiting circuit 5*a* and the waveform shaping circuit 5*b*) together constitute a low voltage system 15.

The diode 6, together with the low voltage system 15 (the current limiting circuit 5*a* and the waveform shaping circuit 5*b*) in the IC 5, is bare chip mounted on the same substrate 12 of the coil driver 2, and similarly, the thick film resistor 7 is mounted on the same substrate 12. On the substrate 12, the high voltage system 14 including the diode 6, and the low voltage system 15 including the current limiting circuit 5*a* and the waveform shaping circuit 5*b* in the IC 5 are separated, in their positions of arrangement, from one another by the earth line 13. The secondary coil low-voltage side terminal 1*c* and the diode 6 are connected to each other by wire bonding, and a space 16 is formed under the wires W.

As described above, according to the first embodiment of the present invention, in the coil driver 2 there is arranged the terminal connected to the secondary coil low-voltage side terminal 1*c*, and the turn-on voltage prevention circuit 8 having the diode 6 in the form of the bare chip and the thick film resistor 7 connected in parallel to each other is inserted between the secondary coil low-voltage side terminal 1*c* and the ground GND, with the turn-on voltage prevention circuit 8 being mounted on the same substrate 12. With such an arrangement, when the ignition coil 1 and the coil driver 2 are produced, it is possible to achieve a reduction in the number of production man-hours as well as a reduction in size of the ignition coil unit in comparison with the case in which a diode for prevention of the turn-on voltage is composed of a discrete part arranged at a location outside the coil driver as in the aforementioned conventional apparatus.

In addition, to construct the diode 6 and the thick film resistor 7 into parallel circuits on the same substrate 12 in the coil driver 2 makes it easy to connect wires. As a result, further reduction in size and cost of the apparatus can be achieved.

Further, the thick film resistor 7 can be easily adjusted in power by changing its pattern, and besides can be formed by means of the same process as that of other resistors. Accordingly, a further reduction in size and cost can be achieved in comparison with the conventional construction in which the thick film resistor 7 (discrete part) is arranged at a location outside of the coil driver.

Furthermore, due to the parallel connection of the thick film resistor 7 and the diode 6, an electric current flows through the thick film resistor 7 so that the electric power supplied to the diode 6 is reduced, thus making it possible to avoid the damage of the diode 6.

In case where the diode 6 with a voltage of about 600 V being impressed thereto is arranged upon mounting the turn-on voltage prevention circuit 8 in the coil driver 2, the low voltage system 15 having a low withstand voltage against a high voltage exists in the coil driver 2 together with the high voltage system 14. As a result, there is a need to separate the high voltage system 14 including the diode 6 and the low voltage system 15 including the IC 5 from each other.

Accordingly, as shown in FIG. 2, on the substrate 12, there is arranged the earth line 13 between the high voltage system 14 including the diode 6, and the low voltage system 15 including the IC 5 (the current limiting circuit 5*a* and the waveform shaping circuit 5*b*), whereby the low voltage system 15 including the IC 5 can be electrically protected from the high voltage system 14 including the diode 6.

The earth line 13 is formed of a line connecting between the emitter terminal of the switching element (IGBT) 3 and the ground GND, and the detection resistor 4 for generating the primary current detected value, which is used by the current limiting circuit 5*a* in the IC 5, is arranged on the earth line 13. As a result, when the high voltage system 14 and the low voltage system 15 are separated from each other, it is not necessary to arrange them on a plurality of substrates (or to form a protective guard or the like) as in the aforementioned conventional apparatus, so the number of production steps or processes as well as the number of component parts can be further reduced.

As is experimentally well-known, it has been found that the turn-on voltage generated at the time when the energization of the primary coil 1*a* is switched from its off state to its on state can be suppressed by increasing the value of the circuit constant of the diode 6 and the thick film resistor 7 in a specific area. Specifically, when the voltage value of the power supply VB is 14 [V], the suppression effect of the turn-on voltage is enhanced by increasing the resistance value of the thick film resistor 7 in the region of the resistance value of the thick film resistor 7 being from 0 [kΩ] to 300 [kΩ]. However, the suppression effect of the turn-on voltage is saturated from the region of the thick film resistor 7 of 300 [kΩ] or more.

Accordingly, when the voltage value of the power supply VB is 14 [V], the optimum resistance value of the thick film resistor 7 connected in parallel to the diode 6 is 300 [kΩ]. When the resistance value of the thick film resistor 7 is set to 300 [kΩ], the suppression effect of the turn-on voltage is increased by increasing the withstand voltage value of the diode 6 connected in parallel to the thick film resistor 7 in the region of the withstand voltage value of the diode 6 being from 0 [V] to 600 [V]. This is because in the region of the withstand voltage value of the diode 6 being less than 600 [V], the diode 6 breaks down and the impedance at the diode 6 side becomes dominant.

As described above, by increasing the withstand voltage of the diode 6, the diode 6 becomes less prone to break down, so the impedance at the thick film resistor 7 side can be made dominant, thereby making it possible to suppress the turn-on voltage. However, when the voltage value of the power supply VB is 14 [V], the suppression effect of the turn-on voltage is saturated in the region of the withstand voltage value of the diode 6 being 600 [V] or more even if the withstand voltage value is increased. This is because under the condition that the voltage value of the power supply VB is 14 [V], the diode 6 does not break down when the withstand voltage value is 600 [V] or more.

The withstand voltage value of the diode 6 is reflected on the size and the cost of the diode 6. Accordingly, by setting the withstand voltage value of the diode 6 to the lowermost voltage value of 600 [V] that is within a range in which the turn-on voltage suppression effect is valid, the size of the diode 6 can be minimized, thereby making it possible to reduce the cost thereof.

As shown in FIG. 2, the space 16 is formed under the wires W by wire bonding the secondary coil low-voltage side terminal 1*c* in the coil driver 2 to the diode 6 for example through the wires W made of aluminum (Al). Accordingly, other parts can be arranged in the space 16, whereby the coil driver 2 can be further reduced in size by the effective use of the space 16.

Embodiment 2

Figure 3:
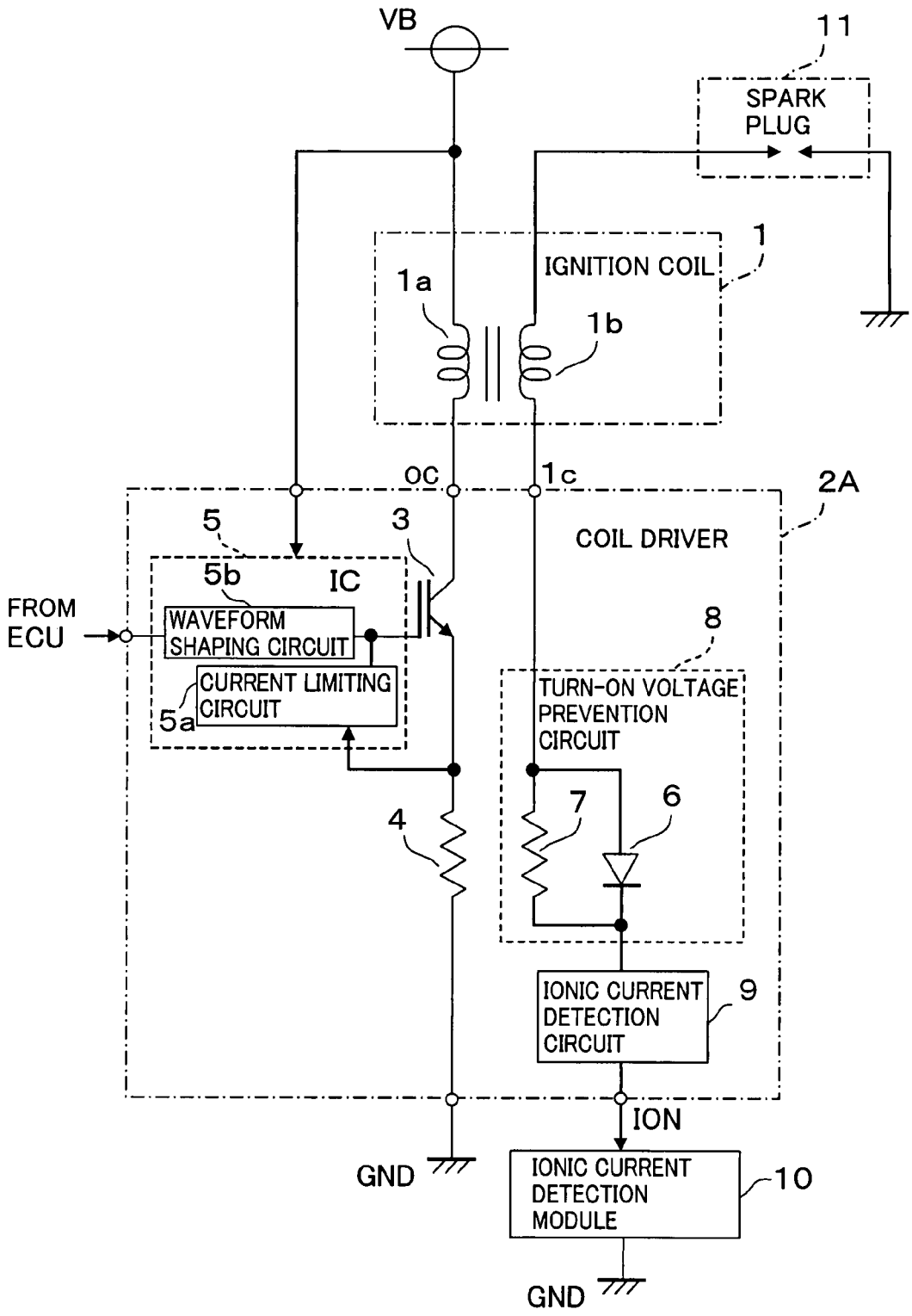
FIG. 3 is a circuit block diagram showing the configuration of an ignition coil and its peripherals in an ignition apparatus for an internal combustion engine according to a second embodiment of the present invention.

Although in the above-mentioned first embodiment, the turn-on voltage prevention circuit 8 has one end thereof directly grounded to the ground GND, it may be indirectly grounded to the ground GND through another system interposed therebetween. For example, one end of the turn-on voltage prevention circuit 8 can be grounded to the ground GND through an ionic current detection circuit 9 and an ionic current detection module 10, as shown in FIG. 3. In this case, the turn-on voltage prevention circuit 8 comprising a parallel circuit of a diode 6 and a thick film resistor 7 is arranged between a secondary coil low-voltage side terminal 1*c* and the ionic current detection circuit 9, so that it is combined with an ionic current detection system.

Figure 4:
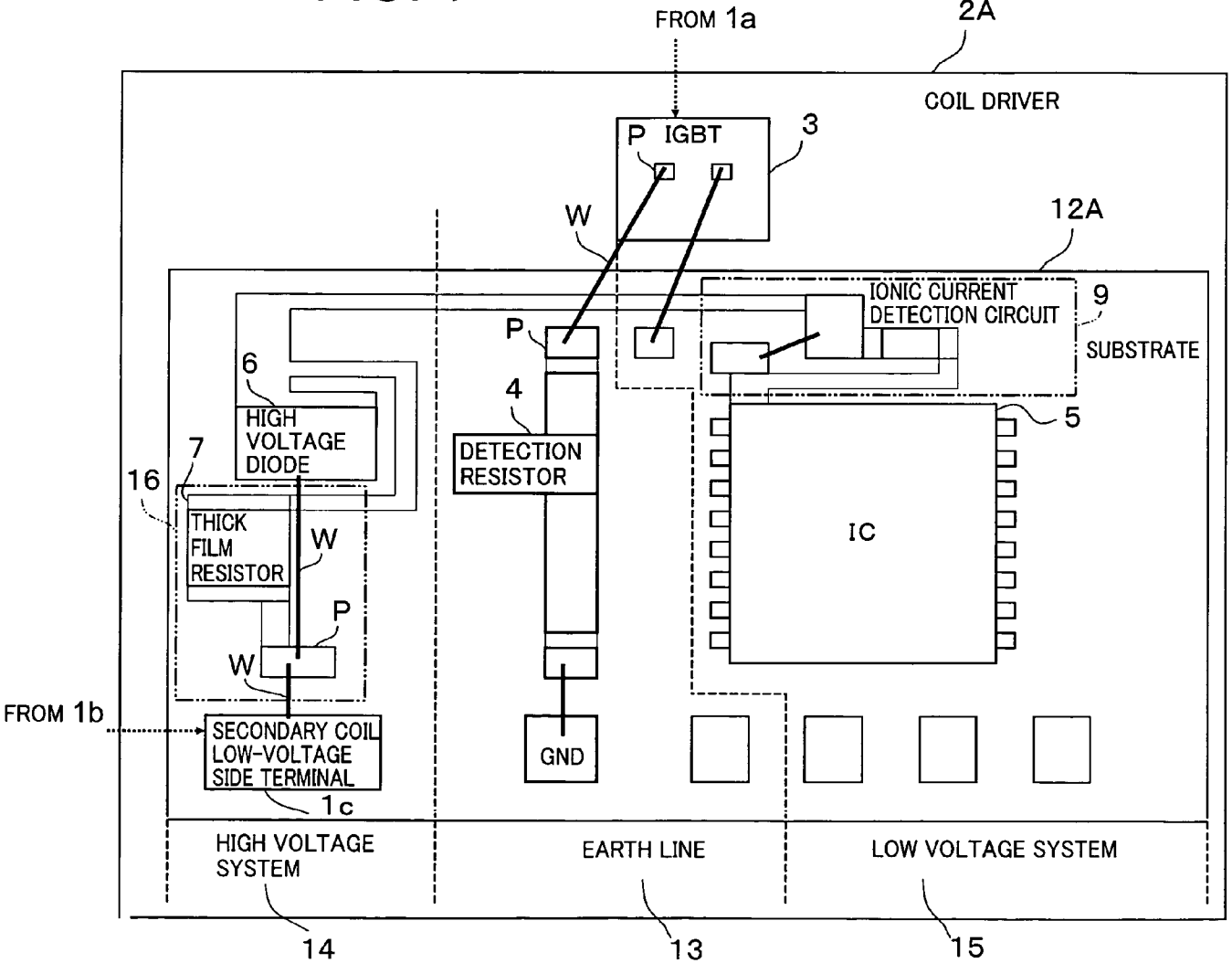
FIG. 4 is an explanatory view showing a planar construction of a mounting pattern on a coil driver according to the second embodiment of the present invention.

FIG. 3 is a circuit block diagram that shows the configuration of an ignition coil and its peripherals in an ignition apparatus for an internal combustion engine according to a second embodiment of the present invention, and FIG. 4 is an explanatory view that shows the planar construction of a mounting pattern on a coil driver 2A in FIG. 3. In FIGS. 3 and 4, the same parts or components as those described above (see FIG. 1 and FIG. 2) are identified by the same symbols or by the same symbols with "A" affixed to their ends, while omitting a detailed explanation thereof.

In FIGS. 3 and 4, the coil driver 2A is provided with the ionic current detection circuit 9 mounted on the same substrate 12A together with the turn-on voltage prevention circuit 8 (the diode 6 and the thick film resistor 7) in addition to the above-mentioned construction.

The ionic current detection circuit 9 is connected to the ionic current detecting module 10 through an ionic current detection terminal ION, and is further grounded to the ground GND through the ionic current detecting module 10. In addition, the ionic current detection circuit 9 is connected to the turn-on voltage prevention circuit 8 through a pattern led out therefrom. The ionic current detecting module 10 may be included in the function of the ECU.

As shown in FIGS. 3 and 4, by connecting the diode 6 in the form of a bare chip and the thick film resistor 7 in parallel to each other, and mounting them on the same substrate 12A as that of the IC 5 between the secondary coil low-voltage side terminal 1*c* and the ground GND, and further by mounting, on the substrate 12A, the ionic current detection circuit 9 connected to the turn-on voltage prevention circuit 8 through the pattern led out therefrom thereby to combine these circuit with each other, the ionic current detection circuit 9 can be formed on the substrate 12A together with the turn-on voltage prevention circuit 8.

In the aforementioned conventional apparatus, the resistor (ionic current path) connected in parallel to the diode is arranged at a location outside the coil driver, but by using, instead of a conventional external resistor (a discrete part having a resistance value of 300 [kΩ]), the thick film resistor 7 in the turn-on voltage prevention circuit 8 inserted between the secondary coil low-voltage side terminal 1*c* and the ionic current detection circuit 9, the ionic current detection circuit 9 in the coil driver 2A can be combined with the thick film resistor 7.

Thus, according to this second embodiment, the reduction in size and cost of the ignition coil unit can be achieved as compared with the case where the diode and the resistor for prevention of the turn-on voltage are arranged outside the coil driver in the form of a discrete part as in the conventional apparatus. In addition, by using the turn-on voltage prevention circuit 8, it is possible to achieve the combination thereof with another system.

As described above, according to the second embodiment of the present invention, by connecting the ionic current detection circuit 9 to the turn-on voltage prevention circuit 8 through the pattern led out therefrom, it is possible to mount, on the same substrate 12A in the coil driver 2, the turn-on voltage prevention circuit 8 and the ionic current detection circuit 9 in combination with each other.

In addition, the thick film resistor 7 of the turn-on voltage prevention circuit 8 can be used while making unnecessary a resistor in the form of a discrete part, which forms an ionic current path, whereby a further reduction in size and cost can be achieved in comparison with the case where the diode and the resistor for prevention of the turn-on voltage are arranged as discrete parts at a location outside of the coil driver.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising:

an ignition coil having a primary coil and a secondary coil;

a spark plug that is arranged in a combustion chamber of said internal combustion engine and is connected to a high voltage side terminal of said secondary coil; and a coil driver that drives said ignition coil;

wherein said coil driver includes:

a switching element that controls a primary current flowing through said primary coil based on an ignition signal;

an IC that shapes the waveform of said ignition signal supplied to said switching element; and a turn-on voltage prevention circuit that is inserted between a low-voltage side terminal of said secondary coil and a ground;

wherein said turn-on voltage prevention circuit is composed of a parallel circuit comprising a diode in the form of a bare chip and a thick film resistor, and is mounted on the same substrate together with said IC.

2. The ignition apparatus for an internal combustion engine as set forth in claim 1, wherein said IC and said diode are separated from each other in their positions of arrangement on said same substrate.

3. The ignition apparatus for an internal combustion engine as set forth in claim 2, wherein said diode and said low voltage system circuit are separated from each other by an earth line.

4. The ignition apparatus for an internal combustion engine as set forth in claim 1, wherein said low-voltage side terminal of said secondary coil and said diode are connected to each other by a wire for wire bonding; and a space is formed under said wire.

5. The control apparatus for an internal combustion engine as set forth in claim 1, wherein said coil driver has an ionic current detection circuit mounted on said same substrate together with said turn-on voltage prevention circuit; and said ionic current detection circuit is connected to said turn-on voltage prevention circuit through a pattern led out therefrom.

* * * * *